United States Patent [19]

Ugalde

[11] Patent Number: 4,936,789

[45] Date of Patent: Jun. 26, 1990

[54] METHOD AND APPARATUS FOR PREVENTING THE THEFT OF A FLUORESCENT LAMP AND BALLAST TRANSFORMER

[76] Inventor: Joseph Ugalde, 6601 - 47th St. Ct. West, Tacoma, Wash. 98466

[21] Appl. No.: 387,894

[22] Filed: Aug. 1, 1989

[51] Int. Cl.[5] ..... H01J 7/44

[52] U.S. Cl. ..... 439/236; 439/232; 29/592.1; 315/58

[58] Field of Search ..... 439/176, 226, 232, 236, 439/242, 243, 300, 402, 419, 436, 437, 438, 439, 440, 441, 611, 645, 227, 359, 307, 642, 339; 362/228, 377; 315/56, 57, 276, 283, 5; 313/493; 336/105, 107; 29/854

[56] References Cited

U.S. PATENT DOCUMENTS

| | | | |
|---|---|---|---|
| 1,174,421 | 3/1916 | Howe, et al. . | |
| 1,611,552 | 12/1926 | Naumburg . | |
| 2,583,353 | 4/1949 | Bishofberger | 336/107 |
| 2,780,791 | 2/1957 | Morschel . | |
| 3,646,582 | 2/1972 | Van Alphen et al. . | |
| 4,422,701 | 12/1983 | Anderson . | |
| 4,530,556 | 7/1985 | Bonus . | |
| 4,575,704 | 3/1986 | Pezold . | |
| 4,623,823 | 11/1986 | Engel | 439/232 |
| 4,637,671 | 1/1987 | Johnson et al. . | |
| 4,750,892 | 6/1988 | Santopietro | 439/307 |
| 4,799,896 | 1/1989 | Gaynor et al. . | |
| 4,811,183 | 3/1989 | Guritz et al. | 362/377 |

FOREIGN PATENT DOCUMENTS

| | | | |
|---|---|---|---|
| 0777951 | 2/1968 | Canada | 439/436 |

*Primary Examiner*—Eugene F. Desmond
*Assistant Examiner*—Walter G. Hanchuk
*Attorney, Agent, or Firm*—Christensen, O'Connor, Johnson & Kindness

[57] ABSTRACT

An adaptor (12) includes a threaded portion (14) intended to be screwed into a conventional lamp socket (18) to replace a standard incandescent light bulb. The adaptor includes spring clips (38) that are operative to prevent removal of terminal pins (36) on the base of a fluorescent lamp (30). A table lamp (20) in which the adapter is installed is connected through a male polarized electrical plug (62) to a remote power supply (68). The power supply is plugged into a conventional AC wall outlet (74). A tamper-proof fastener (78) attaches the power supply to the outlet, preventing it from being removed by a user who does not have access to a special driver required to turn the fastener. Spring clips within the power supply prevent removal of the male plug, so that the table lamp cannot be stolen without cutting the power cord.

22 Claims, 2 Drawing Sheets

METHOD AND APPARATUS FOR PREVENTING THE THEFT OF A FLUORESCENT LAMP AND BALLAST TRANSFORMER

TECHNICAL FIELD

This invention is generally related to a method and apparatus for preventing tampering with and the theft of a lamp, and specifically to a method and apparatus for deterring removal of a fluorescent lamp from a base into which it is installed.

BACKGROUND OF THE INVENTION

Compared to incandescent light bulbs of equivalent light intensity, fluorescent lamps are substantially more efficient. Although fluorescent lamps are initially more expensive to install because they require a special ballast transformer and starter circuit, this cost is more than compensated by their reduced energy consumption and extended operating life.

In order to benefit from the operating energy cost advantage of fluorescent lighting, adapters have been developed in the prior art for replacing a conventional incandescent lamp bulb with a compact U-shaped fluorescent lamp. A typical adapter includes a starter circuit and ballast transformer for the lamp, which is threaded so that it can be readily installed into a conventional incandescent lamp socket, e.g., on a table lamp or floor lamp. The U-shaped fluorescent lamp that is used with the adapter normally includes a base on which are provided a pair of terminal pins that plug into matching receptacles on the adapter to connect the fluorescent lamp with the ballast transformer and starter circuit.

Motels, hotels, and other types of commercial establishments open to public access have been reluctant to install fluorescent lamp and adapter assemblies as replacements for incandescent bulbs because of the ease with which the fluorescent lamp, the adapter, or both may be removed and stolen. The operating cost benefit of the fluorescent lamp compared to a conventional incandescent bulb can quickly be erased by the loss resulting from the theft of only a few such devices.

In U.S. Pat. No. 4,637,671, a theft-resistant device for a fluorescent lamp is disclosed that is operative to lock a U-shaped fluorescent lamp into a mounting base. The locking system relies principally upon a screw provided in the mounting base, which when tightened, impinges on the base of the U-shaped lamp, preventing the fluorescent lamp from being removed from the mounting base. Unfortunately, the type of locking screw disclosed in this patent can be loosened using a conventional screwdriver, permitting someone to easily remove the lamp. In addition, this prior art patent fails to disclose any means for preventing removal of an adapter that would be used to install the U-shaped fluorescent lamp as a replacement for an incandescent bulb in a conventional light socket. Since the adapter and fluorescent lamp in known prior art devices are readily unscrewed from a light socket as a unit, the locking system disclosed in this prior art patent is totally ineffective in preventing theft of the entire lamp and adapter assembly.

In consideration of the problems and disadvantages inherent in the prior art fluorescent lamp and adapter assemblies described above, it is an object of the present invention to prevent theft of a fluorescent lamp and adapter from a conventional incandescent lamp socket in which the lamp and adapter are installed. It is a further object to inhibit removal of the fluorescent lamp from the adapter. Yet a further object is to provide a remote ballast transformer for use with a fluorescent lamp and to inhibit its removal from a wall plug. A still further object is to inhibit removal from the ballast transformer of a conventional AC male plug that is electrically connected to the fluorescent lamp. These and other objects and advantages of the present invention will be apparent from the drawings and from the Description of the Preferred Embodiments that follow.

SUMMARY OF THE INVENTION

In accordance with the present invention, a theft-resistant fluorescent lamp assembly that is intended to replace a conventional incandescent light bulb comprises adapter means for electrically connecting a fluorescent lamp into a generally conventional incandescent light socket. The adapter means include lamp retention means that are operative to prevent removal of the fluorescent lamp from the adapter means, and adapter retention means for preventing removal of the adapter means from the light socket.

The theft-resistant assembly further comprises power supply means for providing electrical current to energize the fluorescent lamp. The power supply means include a ballast transformer that is electrically connected to a generally conventional AC electrical wall outlet, and means for electrically connecting the light socket to the ballast transformer. Furthermore, means are provided for preventing disconnection of the ballast transformer from the wall outlet and for preventing disconnection of the light socket from the ballast transformer.

The ballast transformer is preferably enclosed in a housing that includes a male electrical plug, which is plugged into the AC electrical wall outlet to supply electrical current to the ballast transformer. The light socket is connected through a pair of conductors to a generally conventional male electrical plug that is plugged into a female electrical socket disposed within the housing of the ballast transformer. Disposed in the female electrical socket are spring clips, which comprise the means for preventing disconnection of the light socket from the ballast transformer. The spring clips frictionally engage the male electrical plug so as to resist its retrograde motion, thereby preventing the male electrical plug from being pulled out of the female electrical socket. However, means (accessible only through the rear of the housing) are provided for releasing the male electrical plug from the female electrical socket. The means for preventing disconnection of the ballast transformer from the AC wall outlet comprise a tamper-proof fastener.

The adapter retention means preferably comprise an annular split ring disposed around a threaded portion of the adapter means. One end of the annular split ring is biased radially outward so that it "bites" into an inner threaded surface of the light socket if rotational force is applied to unthread the adapter means from the light socket, thereby preventing the adapter means from being removed.

Spring clips that comprise the lamp retention means frictionally engage and "bite" into terminal pins that are disposed on a base of the fluorescent lamp. The spring clips provide an electrical path for current flow between the fluorescent lamp and the light socket, and prevent retrograde motion of the terminal pins so that they are locked into engagement with the spring clips.

A method for preventing theft of a fluorescent lamp assembly is another aspect of this invention. The method includes steps that generally correspond to the functions provided by the above-described elements of the theft-resistant fluorescent lamp assembly.

DESCRIPTION OF THE PREFERRED EMBODIMENTS

Figure 1:
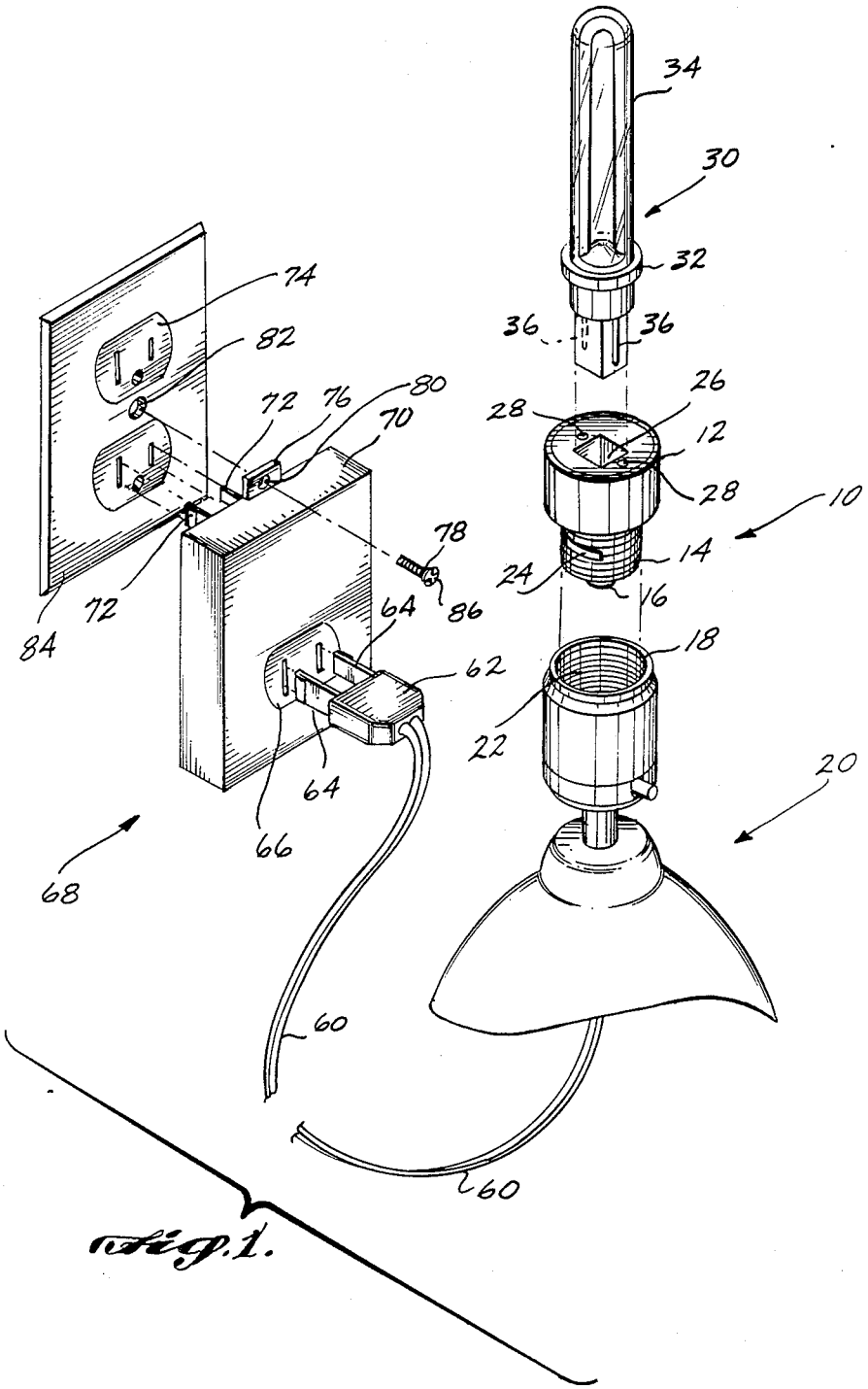
FIG. 1 is an exploded isometric view of the theft-resistant fluorescent lamp assembly and of a portion of a generally conventional table lamp into which the assembly is installed.

With reference to FIG. 1, an exploded view illustrates how the component elements of a theft-resistant fluorescent lamp assembly, which is generally identified by reference numeral 10, are installed in a table lamp 20 to replace a generally conventional incandescent light bulb (not shown). Theft-resistant fluorescent lamp assembly 10 includes an adapter 12, having a threaded portion 14 that is shaped and sized to screw into a conventional incandescent lamp socket 18 on table lamp 20. Threaded portion 14 comprises a metallic surface that is formed into helical threads that make electrical contact with an inner matching threaded surface 22 of lamp socket 18, and an electrical contact 16 formed on the lower distal end of the threaded portion. Electrical contact 16 is insulated from the rest of the threaded portion and makes connection with a central electrical terminal (not shown), which is disposed in the bottom of lamp socket 18. Inset in the threads on threaded portion 14 is an annular split ring 24, which serves to lock threaded portion 14 into the lamp socket, preventing adapter 12 from being unscrewed after it is installed. Details of split ring 24 and its interaction with inner threaded surface 22 of lamp socket 18 are discussed below.

On a top or outer exposed surface 26 of adapter 12 are disposed two spaced-apart holes 28. A fluorescent lamp 30 that is used with the adapter has a base 32 from which extend a pair of terminal pins 36. Spaced-apart holes 28 receive terminal pins 36 when the fluorescent lamp is plugged into adapter 12. Terminal pins 36 are electrically connected to the internal components of a U-shaped tube 34 that comprises the fluorescent lamp, and electrical current is supplied through the terminal pins to cause fluorescence of a phosphor contained within U-shaped tube 34. Fluorescent lamp 30 is thus conventional in construction and is the same type of fluorescent lamp that is commercially available for installation in the prior art incandescent light bulb replacement adapter bases.

Figure 5:
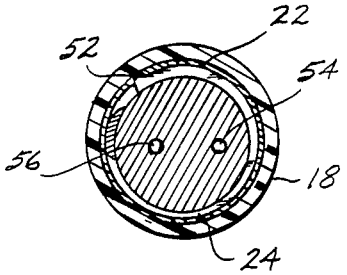
FIG. 5 is a cross-sectional view of the adapter and of a light socket in which it is installed, illustrating an annular split ring that retains the adapter in the light socket.

As explained above, fluorescent lamp 30 can easily be removed and stolen if installed in a conventional prior art adapter. Furthermore, a prior art adapter can easily be unscrewed from the lamp socket and the entire fluorescent lamp and adapter assembly stolen. The present invention resists such theft by its inclusion of means for preventing removal of fluorescent lamp 30 from adapter 12, and means for preventing removal of adapter 12 from lamp socket 18. Details of the mechanism used to prevent lamp 30 from being removed from adapter 12 are shown in FIGS. 2 through 4, while details of the mechanism that prevents adapter 12 from being unscrewed from lamp socket 18 are shown in FIG. 5.

Figure 2:
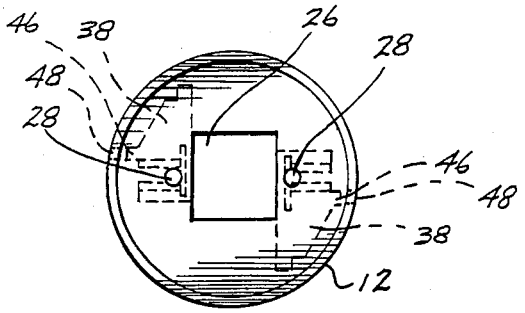
FIG. 2 is a plan view of the top of a fluorescent lamp adapter used in the assembly.
Figure 3:
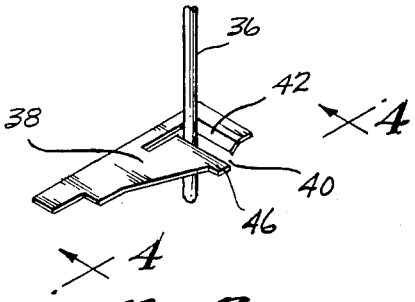
FIG. 3 is an isometric view of a spring clip and of a portion of a fluorescent lamp terminal pin.
Figure 4:
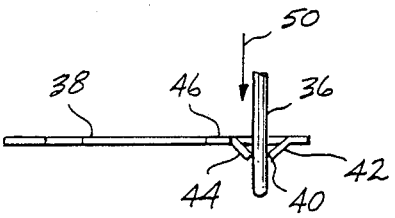
FIG. 4 is a side-elevational view of the spring clip shown in FIG. 3.

With reference to FIGS. 2 through 4, immediately below the top or outer exposed surface 26 of adapter 12 are disposed spring clips 38, which are formed so that they engage terminal pins 36 when fluorescent lamp 30 is installed on adapter 12. Spring clips 38 each include a generally T-shaped slot 40, the center portion of which is defined by edges 42 and 44. Both edges 42 and 44 are bent out of the plane of the spring clip, forming an acute angle with respect to the plane, so that slots 40 readily accept insertion of terminal pins 36 as fluorescent lamp 30 is installed on adapter 12. Although not shown in FIG. 2, one end of each of a pair of electrical conductors 54 and 56 (see FIG. 5) is connected to each spring clip 38, the other ends of the two conductors being respectively connected to threaded portion 14 and electrical contact 16. Thus, spring clips 38 provide electrical continuity between terminal pins 36 and lamp socket 18 when adapter 12 is installed therein. Edges 42 and 44 of slots 40 are formed to deflect during insertion of terminal pins 36 into the slots, due to the inherent elasticity of the metal from which spring clips 38 are formed, and the edges are thus spring biased to "bite" into the outer surface of each terminal pin 36 if any attempt is made to remove the terminal pins from slots 40.

As shown in FIG. 4, an arrow 50 indicates the direction of easy insertion of terminal pin 36 into slots 40. Due to the frictional engagement of edges 42 and 44 with each terminal pin 36, retrograde motion of the terminal pin in a direction opposite to that indicated by arrow 50 is prevented. Accordingly, terminal pins 36 cannot be withdrawn from spring clips 38 (unless released as described below).

Since fluorescent lamp 30 may eventually fail with continued use, means are provided for releasing terminal pins 36 from spring clips 38. However, the release mechanism is not readily accessible nor apparent to a typical user of table lamp 20. The release mechanism is accessed through ports 48, which are formed on diametrically opposite sides of adapter 12. Ports 48 provide access to release arms 46 that extend from the side of each spring clip 38 adjacent the ports. By inserting an insulated rod (not shown) into each of ports 48, release arms 46 on spring clips 38 can be depressed downwardly, thereby increasing the width of slots 40 and disengaging edges 44 from contact with terminal pins 36. Once terminal pins 36 are thus released, fluorescent lamp 30 can be removed from adapter 12 and replaced. Since release arms 46 are electrically energized, the possible insertion of a metallic conductor through ports 48 may represent an unacceptable shock hazard. Accordingly, an alternative design is contemplated, wherein each port 48 gives access to a sliding insulated block that depresses one of release arms 48 upon insertion of an appropriate size rod through the port.

If adapter 12 were readily removable from lamp socket 18 by unauthorized users, the advantage of locking terminal pins 36 of fluorescent lamp 30 in engagement with adapter 12 would be wasted, since the integral assembly could easily be stolen. However, as shown in FIG. 5, split ring 24 includes an end 52 that is spring biased radially outward to lock the adapter into lamp socket 18. End 52 of split ring 24 frictionally engages and bites into the inner threaded surface 22 of lamp socket 18 if a force is applied to rotate adapter 12 in a direction appropriate to unscrew the adapter from the lamp socket. Once installed in lamp socket 18, split ring 24 resists removal of the adapter, preventing theft of the assembled adapter 12 and fluorescent lamp 30.

Although it is contemplated that adapter 12 could be enlarged to incorporate a ballast transformer and starter circuit, as is conventionally provided in prior art adapters for replacing incandescent bulbs with fluorescent lamps, it would then be possible for someone to steal table lamp 20 after the fluorescent lamp and adapter 12 are installed. Accordingly, the preferred embodiment of the present invention includes a remote power supply 68 that is separate from adapter 12.

A line cord 60 that includes conductors connected to the electrical contacts within lamp socket 18 has a conventional AC male polarized electrical plug 62 molded on one end. This plug includes two prongs 64 that are normally inserted into an AC wall outlet to energize table lamp 20. When adapter 12 is installed in lamp socket 18, prongs 64 of plug 62 are instead inserted into a female electrical socket 66, which is provided on remote power supply 68. Female electrical socket 66 is disposed on the front of a housing 70 of the power supply. On the opposite surface of housing 70 is disposed a male polarized electrical plug 72 that is inserted into a generally conventional AC electrical wall outlet 74. (Both male electrical plugs 62 and 72 are preferably polarized to conform to prevalent electrical codes.) Inside housing 70 is provided a fluorescent lamp ballast transformer and starter circuit (neither shown), which are of generally conventional design and appropriate to supply a starting voltage to fluorescent lamp 30 and the electrical current necessary to energize it. The ballast transformer and starter circuit may optionally be electrically connected to male electrical plug 72 through in-line thermal cutouts (not shown), to provide protection against unintentional short circuits that could occur either within table lamp 20, line cord 60, adapter 12, or fluorescent lamp 30.

Disposed along the upper edge of housing 70 is a tab 76 in the center of which is disposed a hole 80. Hole 80 is aligned with a center hole 82 in a conventional cover plate 84 that is fitted to AC electrical wall outlet 74. In place of the retainer screw that is normally used with cover plate 84, a tamper-proof fastener 78 extends through hole 80 and is threaded into hole 82 to hold remote power supply 68 on AC electrical wall outlet 74. Tamper-proof fastener 78 includes a head 86 that is formed to mate with a special driver, not generally available to the public. A star-head machine screw (size 8-32) and a driver such as a KD Torx, Model T-15, are preferably used for this purpose, although other types of tamper-proof fasteners and drivers can also be used. Due to the nature of its design, tamper-proof fastener 78 cannot be removed by a typical user of table lamp 20, because such a person would not ordinarily have access to the special driver required to unscrew the tamper-proof fastener from hole 82.

Figure 6:
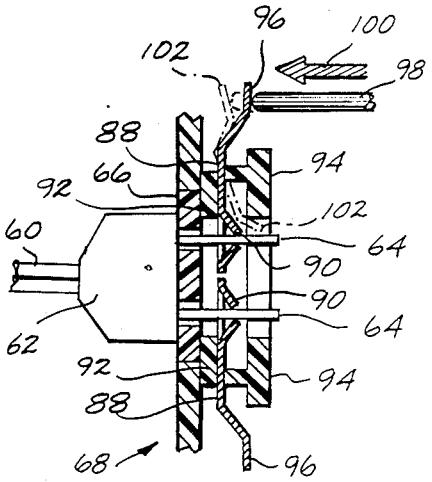
FIG. 6 is a cut-away cross-sectional view of a remote ballast transformer.

To complete the assembly, prongs 64 on male electrical plug 62 are locked into female electrical socket 66 using spring clips 88, as shown in FIG. 6. Spring clips 88 are generally similar in operation to spring clips 38, but each includes a slot 90 that is generally longer than slot 40 to accommodate the width of prongs 64. Spring clips 88 readily permit insertion of prongs 64 through slots 90; however, due to the frictional engagement of the edges of slots 90 with the adjacent surfaces of prongs 64, removal of plug 62 from female electrical socket 66 is prevented. Spring clips 88 are retained in place by spacer blocks 92, that are formed or installed between the inner surface of housing 70 and the adjacent surface of the spring clips. On the opposite surface of the spring clips are disposed pivot terminals 94, which serve a dual purpose. An extension on each pivot terminal 94 acts as a fulcrum about which a segment of the spring clip disposed on one side of slot 90 may pivot. This pivotal action facilitates easy insertion of prongs 64 into slots 90, and facilitates release of prongs 64 from spring clips 88 when release arms 96, which are disposed at the outer ends of spring clips 88, are depressed. To release prongs 64, rods 98 are inserted through ports (not shown) formed in the back surface of housing 70. Rods 98 displace release arms 96 to the position shown by the dash lines at reference numeral 102 as force is exerted by the rods in the direction of arrows 100, causing the width of slots 90 to increase and drawing one edge of each spring clip slot away from prongs 64 so that plug 62 may be removed from female electrical socket 66. Rods 98 may, for example, be connected to a common handle in a wishbone configuration to facilitate simultaneous release of both prongs. Since rods 98 may only be inserted through the ports formed in housing 70 after the power supply is unplugged from AC electrical wall outlet 74, and since power supply 68 is normally connected to AC electrical wall outlet 74 using tamper-proof fastener 78, a typical user of table lamp 20 would not have access to the rear surface of the power supply, and thus could not insert any conductive device through the ports. Once remote power supply 68 is disengaged from the wall socket, there is no risk of electrical shock. Therefore, it is not necessary that rods 98 be insulated.

The present invention inhibits removal of table lamp 20 from remote power supply 68, and removal of remote power supply 68 from the AC electrical wall outlet. Accordingly, in combination, adapter 12 and the above-described remote power supply comprise a theft-resistant system that encourages use of energy conserving fluorescent lamps to replace incandescent bulbs, by substantially reducing the risk that the fluorescent lamp and adapter may be stolen.

While the present invention has been described with respect to a preferred embodiment and modifications thereto, those of ordinary skill in the art will appreciate that further modifications may be made within the scope of the claims that follow. Accordingly, it is not intended that the invention be in any way limited by the disclosure, but that it be determined entirely by reference to the claims.

The embodiments of the invention in which an exclusive property or privilege is claimed are defined as follows:

1. A theft-resistant fluorescent lamp assembly for use in replacing a conventional incandescent light bulb, comprising: adapter means for electrically connecting a fluorescent lamp into a generally conventional incandescent light socket, said adapter means including lamp retention means for preventing removal of the fluorescent lamp from the adapter means, and adapter retention means comprising an annular split ring disposed on the adapter means so as to engage the light socket, for preventing removal of the adapter means from the light socket.

2. The theft-resistant fluorescent lamp assembly of claim 1, further comprising:

(a) power supply means for providing an appropriate electrical current to energize the fluorescent lamp, said power supply means including a ballast transformer electrically connected to a generally conventional AC electrical wall outlet and means for electrically connecting the light socket to the ballast transformer;

(b) means for preventing disconnection of the ballast transformer from the wall outlet; and (c) means for preventing disconnection of the light socket from the ballast transformer.

3. The theft-resistant fluorescent lamp assembly of claim 2, wherein the ballast transformer is enclosed in a housing that includes a male electrical plug, which is plugged into the AC electrical wall outlet to convey electrical current to the ballast transformer.

4. The theft-resistant fluorescent lamp assembly of claim 3, wherein the light socket is connected through a pair of conductors to a generally conventional male electrical plug that is plugged into a female electrical socket disposed within the housing of the ballast transformer.

5. The theft-resistant fluorescent lamp assembly of claim 3, wherein the means for preventing disconnection of the light socket from the ballast transformer comprise spring clips disposed in the female electrical socket into which the male electrical plug connected to the light socket is inserted, said spring clips frictionally engaging the male electrical plug so as to resist its retrograde motion, thereby preventing the male electrical plug from being pulled out of the female electrical socket.

6. The theft-resistant fluorescent lamp assembly of claim 5, further comprising means for releasing the male electrical plug from the female electrical socket.

7. The theft-resistant fluorescent lamp assembly of claim 1, wherein the annular split ring of the adapter retention means is disposed around a threaded portion of the adapter means, one end of said annular split ring being biased radially outward to bite into an inner threaded surface of the light socket if rotational force is applied to unthread the adapter means from the light socket, thereby preventing the adapter means from being removed.

8. The theft-resistant fluorescent lamp assembly of claim 1, wherein the lamp retention means comprise spring clips that frictionally engage and bite into terminal pins, which are disposed on a base of the fluorescent lamp, providing both an electrical path for current flow between the fluorescent lamp and the light socket and preventing retrograde motion of the terminal pins so that they are locked into engagement with the spring clips.

9. The theft-resistant fluorescent lamp assembly of claim 2, wherein the means for preventing disconnection of the ballast transformer from the AC wall outlet comprise a tamper-proof fastener that is used to attach the ballast transformer to the AC wall outlet.

10. The theft-resistant fluorescent lamp assembly of claim 8, further comprising means for releasing the fluorescent lamp from the adapter means by disengaging the spring clips from the terminal pins.

11. Apparatus for preventing theft of a fluorescent lamp, comprising (a) a lamp adapter for adapting the fluorescent lamp to fit into a conventional incandescent light socket; said lamp adapter including:

i. a base portion that is threaded for installation into the conventional incandescent light socket to electrically connect the lamp adapter with electrical contacts disposed in the conventional incandescent light socket;

ii. locking means, disposed within the base portion, for separately lockingly engaging terminal pins provided on the fluorescent lamp, said locking means readily accepting insertion of said terminal pins therein during installation of the fluorescent lamp on the lamp adapter, but operative to prevent withdrawal of the terminal pins from the locking means, thus preventing removal of the fluorescent lamp from the lamp adapter; and iii. adapter retention means, disposed on the base portion, for preventing the lamp adapter from being unthreaded from the incandescent light socket after the lamp adapter is installed therein;

(b) a remote transformer ballast assembly suitable for use in energizing the fluorescent lamp, said transformer ballast assembly being housed in an enclosure, one surface of the enclosure including a conventional male electrical plug for electrically connecting the transformer ballast assembly to a generally conventional AC wall outlet, an opposite surface of the housing including a female electrical socket into which is inserted a generally conventional male AC electrical plug that is electrically connected to the incandescent light socket electrical contacts, electrical current from the ballast assembly being thereby conveyed to the fluorescent lamp;

(c) plug retention means, associated with the female electrical socket in the housing, for preventing the male electrical plug that is electrically connected to the incandescent light socket electrical contacts from being withdrawn after it is inserted into the female electrical socket; and (d) tamper-resistant fastener means for securing the transformer ballast assembly in engagement with the AC wall outlet.

12. The apparatus of claim 11, wherein the locking means comprise a pair of spring clips disposed below an outer surface of the lamp adapter, each spring clip having an opening aligned with a hole formed in the outer surface of the lamp adapter into which one of the terminal pins is inserted, a segment of each spring clip disposed along said opening being formed at an acute angle so as to readily accept the terminal pin as it is inserted into the opening, an edge of the segment being spring biased into frictional engagement with and biting into the terminal pin to prevent its retrograde movement.

13. The apparatus of claim 11, wherein the locking means include means for releasing the terminal pins of the fluorescent lamp, so that the fluorescent lamp can be removed from the lamp adapter, said releasing means being generally concealed within the lamp adapter.

14. The apparatus of claim 11, wherein the adapter retention means comprise an annular split ring inset into the threaded base portion, one end of the split ring being biased radially outward so that the end frictionally engages a thread formed on an interior surface of the incandescent light socket if the lamp adapter is turned counterclockwise after being installed therein.

15. The apparatus of claim 11, wherein the plug retention means comprise a pair of slotted clips, said slotted clips being disposed so that slots formed therein are aligned with slots formed in and extending through an outer surface of the female socket, a portion of each slotted clip including a segment formed at an acute angle to readily accept and spring biased to frictionally engage the electrical plug when it is inserted into the slotted clips, thereby preventing retrograde movement of the electrical plug.

16. The apparatus of claim 11, wherein the plug retention means include means for release of the electrical plug that are accessible through spaced-apart ports formed in the housing.

17. The apparatus of claim 11, wherein the tamper-resistant fastener means comprise a fastener sized to fit a threaded hole in the AC wall outlet, said fastener including a head formed to engage a special driver.

18. A method for preventing theft of a fluorescent lamp assembly used to replace an incandescent light bulb in a generally conventional incandescent light socket, comprising the steps of:

(a) providing an adapter into which terminal pins of a fluorescent lamp are inserted as the fluorescent lamp is mated with the adapter;

(b) providing electrical contacts within the adapter that engage the terminal pins and prevent their removal thus preventing the fluorescent lamp being separated from the adapter; and (c) locking the adapter into the conventional light socket after it is installed therein, so that it cannot readily be removed.

19. The method of claim 18, further comprising the steps of:

(a) providing a remote power supply in a housing that is directly plugged into an AC wall outlet to energize the fluorescent lamp, said light socket being electrically connected to the power supply through an AC line cord and a conventional male electrical plug that is plugged into a female electrical socket disposed in the housing;

(b) preventing removal of the power supply and housing from the AC wall outlet; and (c) preventing removal of the conventional male electrical plug from the female electrical socket disposed in the power supply housing.

20. The method of claim 18, further comprising the step of enabling removal of the fluorescent lamp from the adapter by insertion of a special tool through ports in the adapter.

21. A theft-resistant fluorescent lamp mount for use in replacing a conventional incandescent light bulb with a fluorescent lamp having a base from which terminal pins extend, comprising:

an adapter assembly having a socket that is formed and sized to connect with the fluorescent lamp base, said adapter assembly including threads so that it can be threaded into a generally conventional incandescent light socket;

spring clip means disposed within the adapter assembly for engaging the terminal pins of the fluorescent lamp, thus preventing the fluorescent lamp being removed from the adapter assembly; and a spring biased split ring, disposed on the threads of the adaptor assembly, said split ring having an end that is biased radially outwardly so as to frictionally engage an inner surface of the light socket and thus prevent the adapter assembly being removed from the light socket.

22. A theft-resistant fluorescent lamp assembly for use in replacing a conventional incandescent light bulb, comprising:

(a) adapter means for electrically connecting a fluorescent lamp into a generally conventional incandescent light socket and preventing its removal therefrom;

(b) power supply means for providing an appropriate electrical current to energize the fluorescent lamp, said power supply means including a ballast transformer electrically connected to a generally conventional AC electrical wall outlet and means for electrically connecting the light socket to the ballast transformer;

(c) means for preventing disconnection of the ballast transformer from the wall outlet; and (d) means for preventing disconnection of the light socket from the ballast transformer.

* * * * *